United States Patent [19]

Reisem

[11] Patent Number: 4,513,271

[45] Date of Patent: Apr. 23, 1985

[54] MOMENTARY CONTACT MAGNETIC SWITCH

[75] Inventor: Daniel E. Reisem, Maplewood, Minn.

[73] Assignee: Minnesota Mining and Manufacturing Company, St. Paul, Minn.

[21] Appl. No.: 399,261

[22] Filed: Jul. 16, 1982

[51] Int. Cl.[3] ..... H01H 9/00

[52] U.S. Cl. ..... 335/205; 200/67 F; 200/159 B

[58] Field of Search ..... 335/205; 200/67 F, 159 B, 200/340, 5 A; 235/145 R; 400/479, 479.2

[56] References Cited

U.S. PATENT DOCUMENTS

| | | | |
|---|---|---|---|
| 3,052,778 | 9/1962 | Kathe . | |
| 3,098,907 | 7/1963 | Reed et al. . | |
| 3,226,506 | 12/1965 | Angrisani . | |
| 3,233,060 | 2/1966 | Wintriss . | |
| 3,247,342 | 4/1966 | Ott et al. . | |
| 3,256,400 | 6/1966 | Wintriss . | |
| 3,260,821 | 7/1966 | Yokoo . | |
| 3,292,125 | 12/1966 | Berry . | |
| 3,349,352 | 10/1967 | Zandt . | |
| 3,403,363 | 9/1968 | Pearse et al. . | |
| 3,423,705 | 1/1969 | Cherry et al. . | |
| 3,447,110 | 5/1969 | Dotto . | |
| 3,458,841 | 7/1969 | Davis . | |
| 3,588,766 | 6/1971 | Baermann . | |
| 3,593,236 | 7/1971 | Beck . | |
| 3,601,727 | 8/1971 | Hults . | |
| 3,644,856 | 2/1972 | Scott . | |
| 3,681,723 | 8/1972 | Goll . | |
| 3,691,490 | 9/1972 | Ragni . | |
| 3,693,123 | 9/1972 | Pedersen . | |
| 3,701,064 | 10/1972 | Kinoshita et al. . | |
| 3,743,980 | 7/1973 | Steiner . | |
| 3,778,737 | 12/1973 | Bowerman . | |
| 3,815,066 | 6/1974 | Vinal . | |
| 3,842,377 | 10/1974 | Barndt . | |
| 3,863,182 | 1/1975 | Lapointe . | |
| 3,906,417 | 9/1975 | Serras-Paulet . | |
| 3,916,360 | 10/1975 | Pedersen et al. . | |
| 3,971,902 | 7/1976 | Wolf et al. | 200/5 A |
| 3,980,979 | 9/1976 | Prosser et al. . | |
| 4,001,744 | 1/1977 | Conrad . | |
| 4,054,944 | 10/1977 | Lau . | |
| 4,057,773 | 11/1977 | Cohen . | |
| 4,058,693 | 11/1977 | Schulz et al. . | |
| 4,068,202 | 1/1978 | Lyons . | |
| 4,075,588 | 2/1978 | Verger et al. . | |
| 4,112,401 | 9/1978 | Palmer et al. . | |
| 4,142,168 | 2/1979 | Natland . | |
| 4,150,350 | 4/1979 | Fong . | |
| 4,170,730 | 10/1979 | Guendulain . | |
| 4,211,991 | 7/1980 | Lombard et al. . | |
| 4,269,521 | 5/1981 | Longrod . | |
| 4,293,754 | 10/1981 | Komaki . | |
| 4,296,394 | 10/1981 | Ragheb . | |
| 4,300,029 | 11/1981 | Maser . | |
| 4,314,112 | 2/1982 | Misson et al. . | |
| 4,314,117 | 2/1982 | Ditzig . | |
| 4,354,081 | 7/1980 | Serras-Paulet | 200/67 F |

*Primary Examiner*—E. A. Goldberg
*Assistant Examiner*—George Andrews
*Attorney, Agent, or Firm*—Donald M. Sell; James A. Smith; William D. Bauer

[57] ABSTRACT

A momentary contact magnetic snap action electrical switch (10) having a magnetic cover plate (12) with an aperture (14, 16) therein, a flexible sheet magnet (18) positioned in back of the cover plate (12) in a normal position magnetically attracted to the cover plate (12) and movable to an actuated position away from the cover plate (12) by manual actuation through the aperture (14, 16), and contacts (24, 34, 26, 36) positioned in cooperation with the flexible sheet magnet (18) for providing a change in electrical continuity when the flexible sheet magnet (18) is moved between the normal position and the actuated position.

21 Claims, 8 Drawing Figures

MOMENTARY CONTACT MAGNETIC SWITCH

BACKGROUND OF THE INVENTION

The present invention relates generally to electrical switches and more particularly to momentary contact electrical switches having a magnetic snap action.

Various prior art electrical switches have encompassed various forms of snap action providing tactile feedback to the actuator. Some of these electrical switches have utilized a magnetic snap action. In an electrical switch having a magnetic snap action, magnetic attraction holds the switch in a first position. Actuation of the switch (either mechanically or magnetically) overcomes the magnetic attractive force holding the switch in that first position. As the switch moves toward a second position, the original magnetic attraction rapidly decreases due to the increased spacing between the magnetic components. This rapidly decreasing magnetic attractive force results in a "snap" to the observer as the switch moves to the second position. These prior art electrical switches can be either momentary contact or dual stable position and can have magnetic attraction in one or both directions of operation. Many differing styles of these electrical switches occur in the prior art including rocker switches, pushbutton switches and reed switches.

Further, there exist in the prior art relatively thin electrical switches utilizing flexible membranes. Many of these flexible membrane switches utilize a mechanical resilience, such as a spring or the mechanical rigidity of the membrane itself, in their switching action.

U.S. Pat. No. 3,681,723, Goll, Magnetic Membrane Switch, issued Aug. 1, 1972, discloses a flexible membrane switch. The switch in Goll uses magnetic repulsion between two magnetic elements to keep the elements spaced apart when the switch is not being actuated. Mechanical actuation of the switch must overcome this magnetic repulsion. With the switch in Goll at least one of the magnetic elements is a flexible sheet magnet. In addition to requiring two magnetic elements, the actuation force will continue to increase as the switch is actuated and the magnetic members come closer together. In fact, the actuation force will be at a maximum when the switch is fully actuated.

SUMMARY OF THE INVENTION

The electrical switch of the present invention utilizes a magnetic cover plate having an aperture contained therein. A flexible sheet magnet is positioned in back of the cover plate in a normal position magnetically attracted to the cover plate and movable to an actuated position away from the cover plate by manual actuation through the aperture. Contact means are positioned in cooperation with the flexible sheet magnet. The contact means provide for a change in electrical continuity when the flexible sheet magnet is moved between the normal position and the actuated position.

The cover plate of the electrical switch may have a housing having an aperture therein substantially enclosing the front of the switch and, in addition, a magnetic plate mounted to the housing.

In various alternative embodiments the contact means can be either separate spaced contacts within the electrical switch or may utilize either the cover plate or a back plate as one of the electrical contacts.

In a further preferred embodiment a flux return plate may be provided on the side of the flexible sheet magnet opposite the magnetic cover plate to improve the magnetic attraction characteristics between the flexible sheet magnet and the magnetic cover plate.

An electrical switch so constructed provides many significant advantages. The switch provides a momentary contact having a magnetic snap action providing tactile feedback to the actuator and a spring-like return to the non-actuated position. The magnetic action releases as the switch is actuated giving rapid and positive contact engagement providing less arcing and resultant errosion of the electrical contacts. The magnetic force sharply decreases as the magnetic attraction between the flexible sheet magnet and the magnetic cover plate releases due to the increased separation between them providing an ideal tactile feedback of operation to the actuator. The electrical switch is relatively thin utilizing a flexible magnetic membrane providing for good aesthetics, easy mounting, e.g. on a wall surface, and for relatively low cost. Further, the electrical switch described requires only one magnetic element in direct contrast to the more complicated and less desirable operating switches of the prior art.

BRIEF DESCRIPTION OF THE DRAWINGS

The foregoing advantages, construction and operation of the present invention will become more readily apparent from the following description and accompanying drawings in which.

DESCRIPTION OF THE PREFERRED EMBODIMENTS

Figure 1:
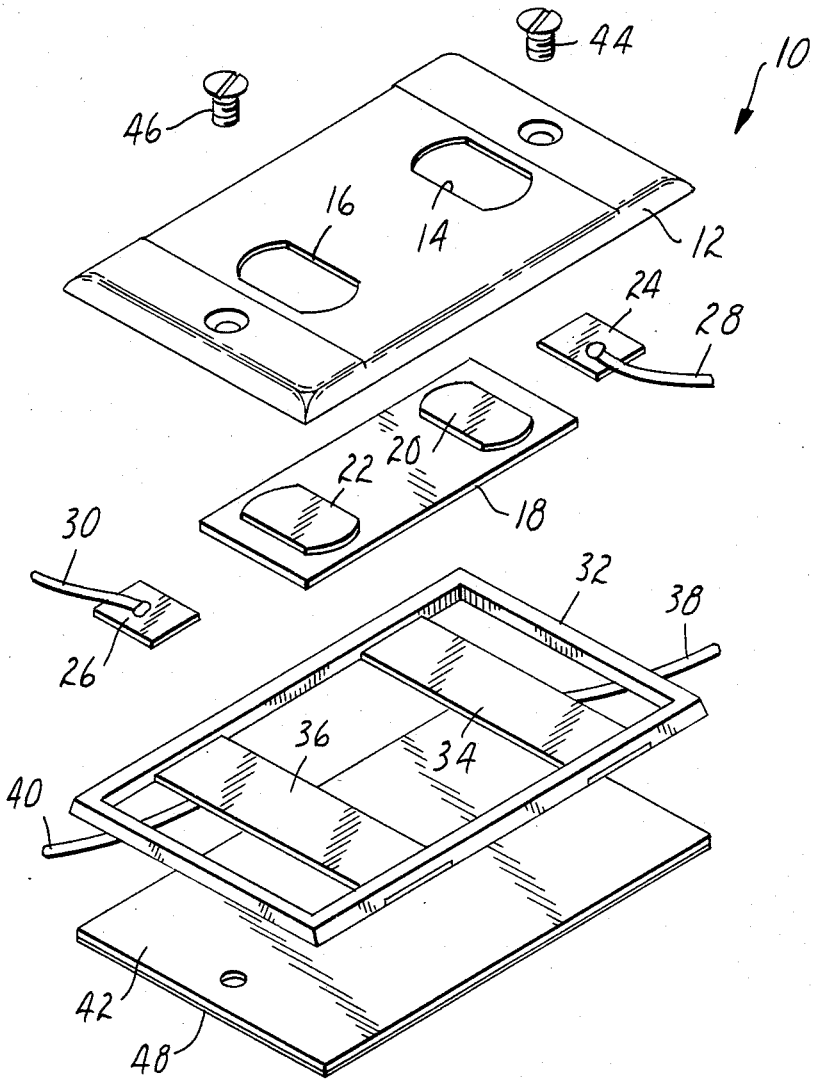
FIG. 1 is an isometric explosion view of one preferred embodiment of the electrical switch of the present invention.

FIG. 1 shows an isometric explosion view of an electrical switch 10 of the present invention. A magnetic cover plate 12 is shown containing two apertures 14 and 16. Positioned behind the magnetic cover plate 12 is a flexible sheet magnet 18. Projections 20 and 22 mate with apertures 14 and 16, respectively, when the flexible sheet magnet 18 is attracted to the magnetic cover plate 12. Contact element 24 is mounted on the flexible sheet magnet 18 opposite projection 20. Similarly, contact element 26 is mounted on flexible sheet magnet 18 opposite projection 22. Contact element 24 is coupled to a wire 28 and contact element 26 is connected to a wire 30. Spacer 32 separates contact element 24 from contact element 34 when the electrical switch 10 is not actuated. Similarly, spacer 32 separates contact element 26 from contact element 36. Contact element 34 is coupled to wire 38 while contact element 36 is coupled to wire 40. Back plate 42 completes the assembly of the electrical switch 10 and is held in place with fasteners 44 and 46. Fasteners 44 and 46, which may be screws, can be used to hold the electrical switch assembly together and, in addition, could be utilized to mount the electrical switch 10 to a suitable mounting surface. Alternatively, adhesive 48 may be attached to the rear of back plate 42 for the suitable mounting of the electrical switch 10.

Figure 2:
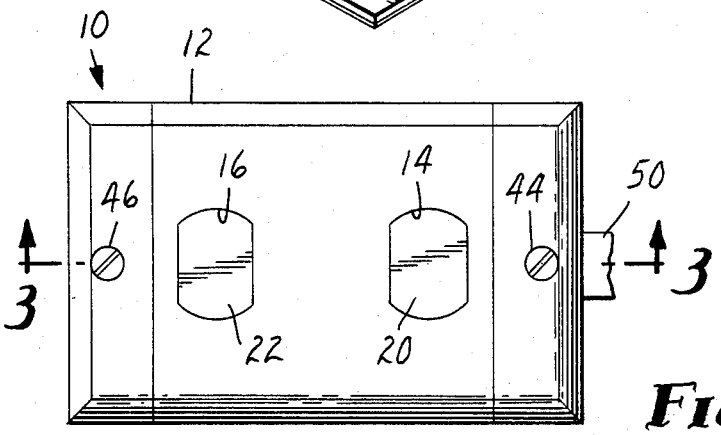
FIG. 2 is a top (plan) view of the electrical switch of FIG. 1.

The electrical switch 10 of FIG. 1 is illustrated in a top plan view in FIG. 2. From the top, only the magnetic cover plate 12, projections 20 and 22 projecting through apertures 14 and 16, respectively, along with fasteners 44 and 46, are visible. A ribbon cable 50 is shown attached to the electrical switch 10 illustrating an alternative embodiment in which wires 28, 30, 38 and 40 in FIG. 1 could be separate conductors of the ribbon cable 50. Utilization of the ribbon cable 50 is particularly advantageous where the electrical switch 10 is surface mounted, perhaps by adhesive 48 onto a flat surface such as a wall.

The magnetic cover plate 12 may be constructed from any suitable material as long as it or a component of it allows for magnetic attraction. Notice that it is not required that the magnetic cover plate 12 be a magnetic material itself, only that it allows magnetic attraction to it. A suitable material for the magnetic cover plate 12 would be a metal, e.g. steel corrosion resistant, type 430. It may be desirable that the exterior of the electrical switch 10 be constructed of a non-conductor or a non-magnetic material such as plastic. In this event a plastic housing can be formed on the outside with a magnetic plate, e.g. cold rolled steel, mounted to the housing for the purpose of allowing for the magnetic attraction to the cover plate. In a preferred embodiment the magnetic cover plate 12 has a thickness from 1/64 of an inch (0.40 millimeters) to ⅛ of an inch (3.18 millimeters) and in a still preferred embodiment is 1/32 of an inch (0.79 millimeters) thick.

While the electrical switch 10 illustrated in FIGS. 1 and 2 show two apertures 14 and 16, only one aperture (e.g. 14) is required for the proper operation of a momentary contact switch. The embodiment illustrated in FIGS. 1 and 2 contain two apertures 14 and 16, aperture 14 being a momentary "ON" contact with aperture 16 allowing for the actuation of a momentary "OFF" contact. Further, the electrical switch 10 shown in FIGS. 1 and 2 has a pair of contacts 24 and 34 and a second pair of contacts 26 and 36. Again, if only one aperture (e.g. 14) were utilized within the electrical switch 10 then only one set of contacts (e.g. 24 and 34) would be required.

The preferred material for the flexible sheet magnet 18 are ferrite particles dispersed in a non-magnetic binder. A preferred example of such a material would be Plastiform ® sheet magnet manufactured by Minnesota Mining and Manufacturing Company, St. Paul, Minn. In particular, an alternating pole Plastiform magnet is utilized and in a preferred embodiment contains eight poles per inch. The preferred thickness for the flexible sheet magnet 18 is from 1/32 (0.79 millimeters) of an inch to ⅛ of an inch (3.18 millimeters) and in a still preferred embodiment is 1/16 of an inch (1.59 millimeters) thick. The electrical switch 10 illustrated in FIGS. 1 and 2 shows projections 20 and 22 projecting through apertures 14 and 16, respectively. These projections, while providing a wear resistant surface, are not required and are not essential to the proper operation and functioning of the electrical switch 10. Without the projections 20 and 22 the electrical switch 10 can still be actuated by a manual operator through apertures 14 and 16. Projections 20 and 22 are sized slightly smaller than operatures 14 and 16 and do provide some amount of lateral positioning and stability for the flexible sheet magnet 18 contained in the assembled electrical switch 10. However, these projections 20 and 22 are not required for this purpose either. The flexible sheet magnet 18 may be sized to substantially encompass the interior surface of the magnetic cover plate 12 and thus be relatively laterally fixed in position. Note however that projections 20 and 22, if desired, do not add to the total over-all thickness of the electrical switch 10.

Contacts 24, 26, 34, and 36 may be constructed from any suitable electrical conductor, e.g. copper, brass, silver or gold. In a preferred embodiment each contact has a thickness from 0.001 inch (0.025 millimeters) to 0.062 inch (1.57 millimeters) and in a still preferred embodiment has a thickness of 0.010 inch (0.25 millimeters).

The contact assembly in the electrical switch 10, illustrated in FIGS. 1 and 2, has a spacer 32 maintaining a separation between the sets of contacts 24–34 and 26–36. In a preferred embodiment the spacer 32 is constructed from an insulative material. In a preferred embodiment the spacer 32 ranges in thickness from 1/64 of an inch (0.40 millimeters) to ⅛ of an inch (3.18 millimeters) and in a still preferred embodiment is 1/32 of a inch (0.79 millimeters) thick.

The back plate 42, illustrated in FIG. 1, may not be required for all embodiments and installations of the electrical switch 10. If it were contemplated that the electrical switch 10 could be mounted to an existing electrical switch box, for example, then fasteners 44 and 46 could attach the electrical switch 10 assembly into such electrical box (not shown). However, in an alternative embodiment, it may be desirable to attach the electrical switch 10 directly to a flat surface such as a wall without an existing opening or electrical box outlet. In such a case it may be desirable to have a back plate 42 on the rear surface of the electrical switch 10. Such fasteners 44 and 46 would be utilized only to secure the electrical switch 10 assembly together and an adhesive 48 located on the rear of back plate 42 could be utilized to affix the electrical switch 10 to a suitable flat surface, such as a wall. In a preferred embodiment a pressure sensitive foam is utilized. In a preferred embodiment the adhesive 48 ranges in thickness from 1/64 of an inch (0.40 millimeters) to ¼ of an inch (6.35 millimeters) and in a still preferred embodiment is 1/16 of an inch (1.59 millimeters) thick. In a preferred embodiment the back plate 42 ranges in thickness from 1/64 of an inch (0.40 millimeters) to ⅛ of an inch (3.18 millimeters) and in a still preferred embodiment is 1/32 of an inch (0.79 millimeters) thick. Back plate 42 can be constructed of any suitable material, but if conductive, then contact insulation may be required between the back plate 42 and contacts 34 and 36. In a preferred embodiment such contact insulation ranges in thickness from 0.002 inches (0.05 millimeters) to 0.010 inches (0.25 millimeters) and in a still preferred embodiment is 0.005 inches (0.127 millimeters) thick. Such contact insulation, of course, may be eliminated if the back plate 42 is constructed from an insulative material.

Utilizing the preferred thicknesses for the various components of the electrical switch 10, it can be seen that an electrical switch 10 can be constructed which ranges in thickness from $\frac{1}{8}$ of an inch (3.18 millimeters) to 1 inch (25.4 millimeters) in thickness and in a still preferred embodiment is 3/16 of an inch (4.76 millimeters) thick.

Figure 3:
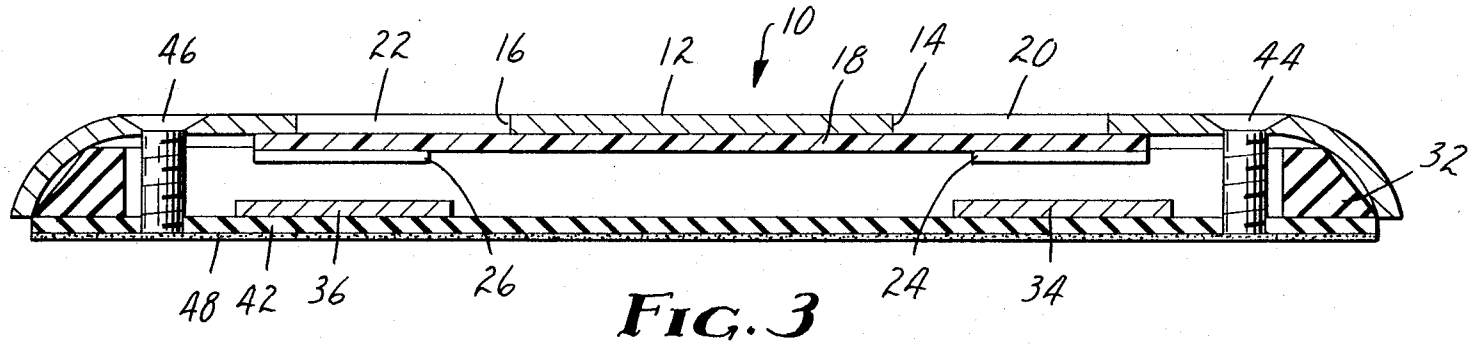
FIG. 3 is a side cross-sectional view of the electrical switch of FIG. 1 in a non-actuated position.
Figure 4:
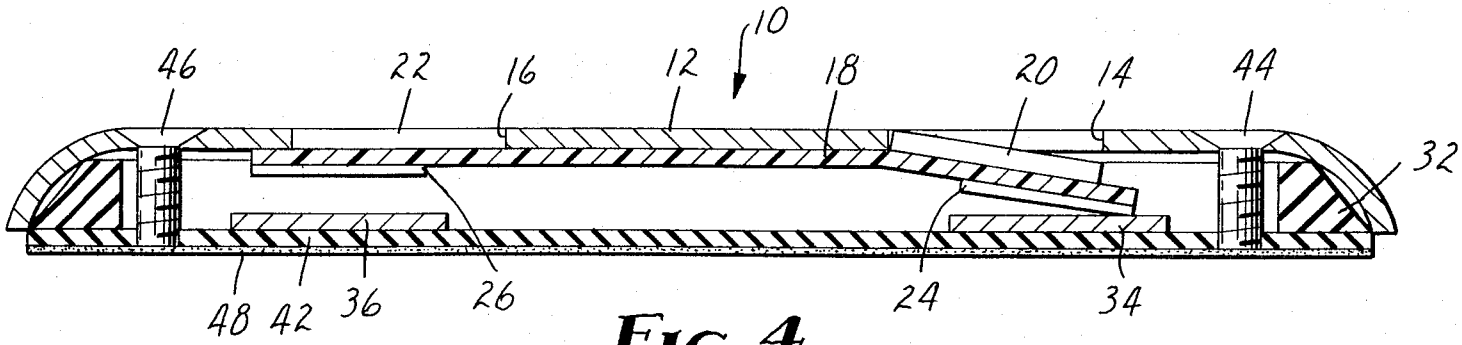
FIG. 4 is a side cross-sectional view of the electrical switch of FIG. 1 in an actuated position.

Operation of the electrical switch 10 can be more readily observed by reference to FIGS. 3 and 4 which show a cross-sectional side view of the electrical switch 10. FIG. 3 shows electrical switch 10 in the non-actuated (normal) position while FIG. 4 shows the electrical switch 10 with the switch in an actuated position. Both Figures show cover plate 12 with the flexible sheet magnet 18 attracted to it. Projection 20 projects into aperture 14 while projection 22 projects into aperture 16. Contacts 34 and 36 are mounted on back plate 42 which is held to the cover plate 12 with fasteners 44 and 46 inserted through spacer 32. In the non-actuated position of FIG. 3, neither contact pairs (namely 24/34 and 26/36) are engaged as the flexible sheet magnet 18 is attracted to the magnetic cover plate 12 providing for the separation of the contact elements. FIG. 4 illustrates the actuated position with an operator having engaged the electrical switch 10 by pressing upon projection 20 which is shown partially displaced from aperture 14. The flexible sheet magnet 18 has deflected as it is pushed away from the magnetic cover plate 12 allowing contact elements 24 and 34 to engage. The flexible sheet magnet 18 flexes allowing contact elements 24 and 34 to engage without disturbing contact elements 26 and 36. In a preferred embodiment an adhesive may be used to adhere flexible sheet magnet 18 to magnetic cover plate 12 at a position intermediate apertures 14 and 16 in order to insure that actuation of projection 20 does not affect contact elements 26 and 36 or shift the position of flexible sheet magnet 18 relative to aperatures 14 and 16.

Figure 5:
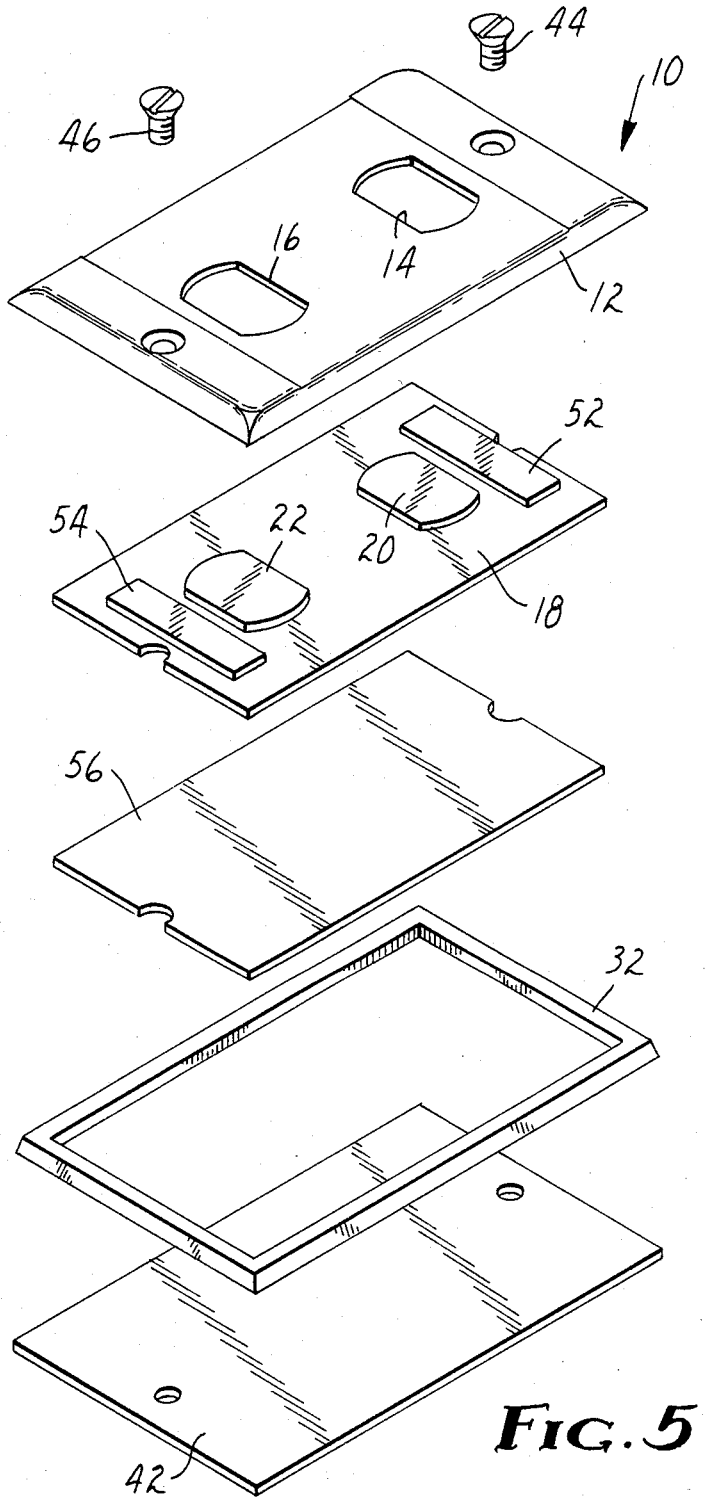
FIG. 5 is an isometric explosion of an alternative embodiment utilizing the magnetic cover plate for one contact element and illustrating a keeper plate positioned behind the flexible sheet magnet.

FIG. 5 illustrates an isometric explosion view of an alternative embodiment of the electrical switch 10. In FIG. 5 a cover plate 12 again has apertures 14 and 16, flexible sheet magnet 18 with projections 20 and 22 partially entering apertures 14 and 16 respectively. In this embodiment instead of contact elements on the rear of the flexible sheet magnet 18, contact elements 52 and 54 are disposed on the flexible sheet magnet 18 toward the magnetic cover plate 12. Further, a flux return plate 56 is disposed on the rear side of the flexible sheet magnet 18. Spacer 32, back plate 42, fasteners 44 and 46 are similar to the embodiment in FIG. 1.

With a magnetic cover plate 12 which is conductive, contact elements 52 and 54 can mate with the magnetic cover plate 12 to form two pairs of contacts, namely contact element 52 and magnetic cover plate 12, and secondly, contact element 54 and magnetic cover plate 12. Constructed in this fashion the momentary action switch has normally closed the contact elements and actuation of the electrical switch 10 would move a pair of contacts to an open position. In this preferred embodiment flux return plate 56 is shown disposed next to flexible sheet magnet 18 opposite magnetic cover plate 12. It has been determined that the flux return plate 56, when constructed from a magnetic material, enhances the magnetic attraction of the flexible sheet magnet 18 to the magnetic cover plate 12. Flux return plate 56 may be constructed from any suitable flexible metallic magnetic material and may be from 0.001 of an inch (0.0254 millimeters) thick to 0.010 of inch (0.254 millimeters) thick with 0.002 of an inch (0.0508 millimeters) being preferred.

Figure 6:
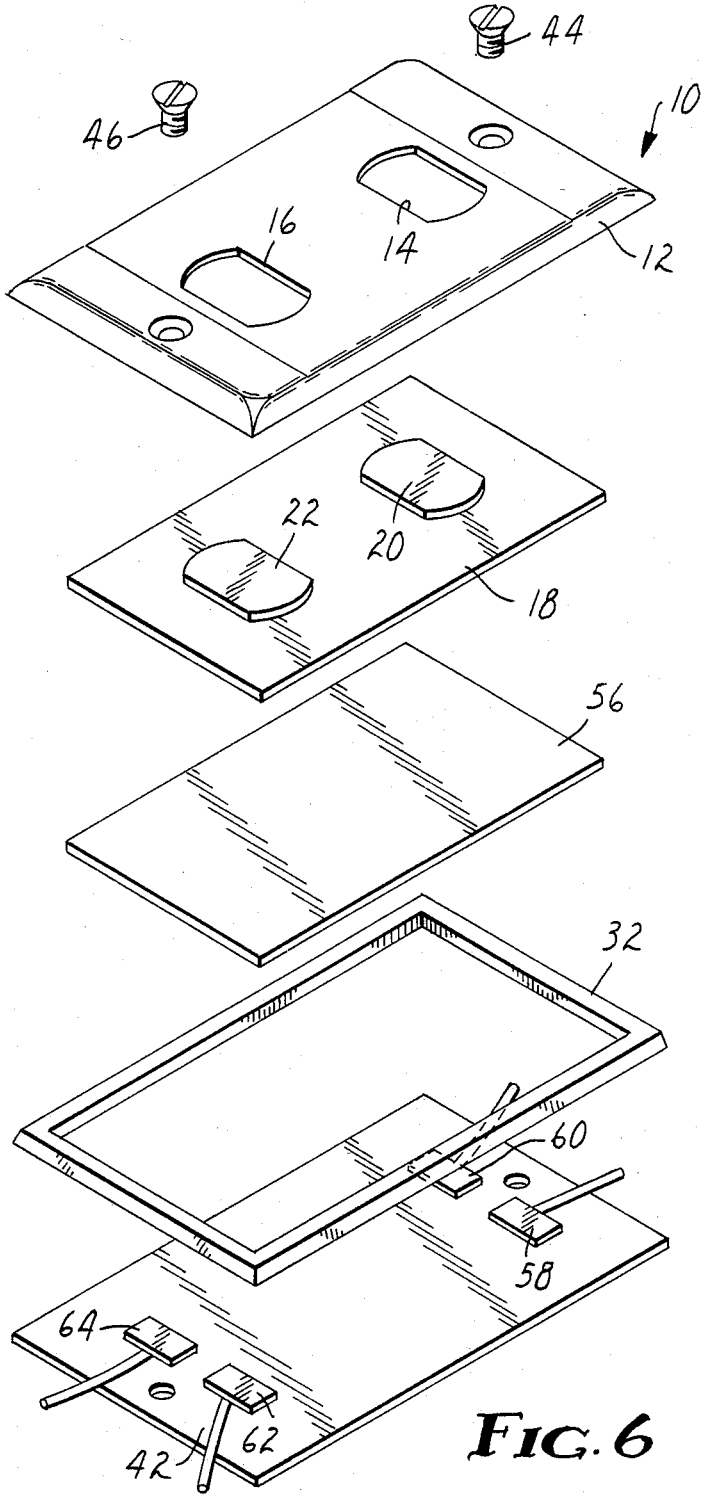
FIG. 6 is an isometric explosion of an alternative embodiment similar to FIG. 5 utilizing the magnetic cover plate as the bridging contact.

FIG. 6 is an isometric explosion view of a preferred embodiment of the electrical switch 10. In FIG. 6, a stationary set of contact elements 58 and 60 cooperate with the movable, conductive flux return plate 56 as a bridging conductor to form one pair of contacts. Similarly stationary set of contact elements 62 and 64 cooperate with flux return plate 56 as a bridging conductor to form a second pair of contacts. The electrical switch 10 would operate in a normally open position with contact pairs 58 and 60 and 62 and 64, selectively, becoming closed when the switch 10 is actuated.

Figure 7:
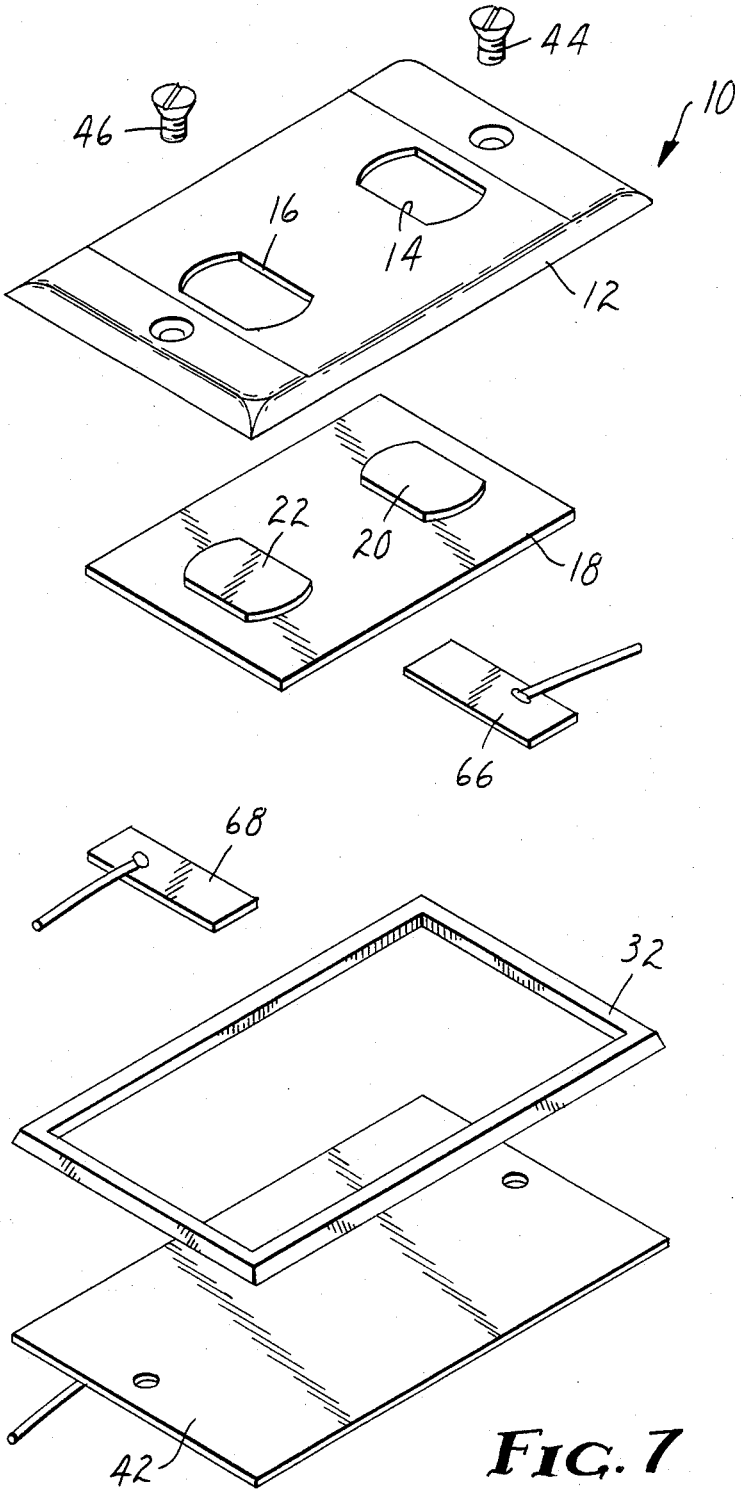
FIG. 7 is an isometric explosion of an alternative embodiment utilizing a back cover as a contact element.

FIG. 7 shows an isometric explosion view of still another embodiment of the electrical switch 10. The embodiment illustrated in FIG. 7 is shown constructed again without flux return plate 56. Contact element 66 is mounted on the rear side of the flexible sheet magnet 18 and cooperates with a conductive back plate 42 to form a pair of contact elements. Similarly contact element 68 is also mounted on the rear of flexible sheet magnet 18, and with conductive back plate 42, forms a second pair of contact elements. The electrical switch 10 illustrated in FIG. 7 would have a normally open repose.

Figure 8:
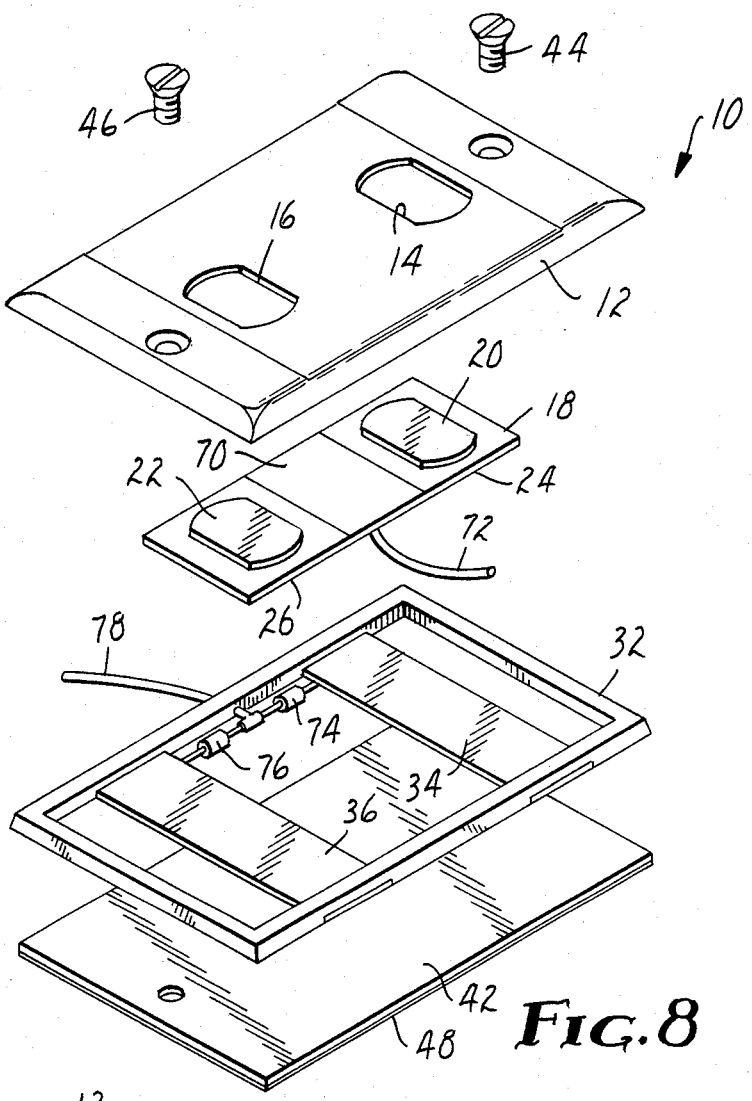
FIG. 8 is an isometric explosion of an alternative embodiment encompassing a dual polarity switch.

The alternative embodiment of the electrical switch 10 illustrated in FIG. 8 shows that a dual polarity momentary contact switch can be constructed from the materials of the present invention. The embodiment illustrated in FIG. 8 is very similar to the embodiment illustrated in FIG. 1. As alluded to earlier, an adhesive 70 is shown securely attaching the flexible sheet magnet 18 to the magnetic cover plate 12 at a position intermediate apertures 14 and 16. Further, contact elements 24 and 26 on the rear of flexible sheet magnet 18 responsive to projections 20 and 22, respectively are electrically coupled together and to wire 72. Contact elements 24 and 34 are also electrically coupled together through diodes 74 and 76 to a common wire 78. Depending on the orientation of diodes 74 and 76, the engagement of contact elements 24 and 34 or the engagement of contact elements 26 and 36 will result in the allowance of a particular current flow in one direction or the other in wires 72 and 78. Diodes 74 and 76 may reside in the thickness encompassed by the spacer 32 and do not contribute to an additional thickness to the electrical switch 10.

It has been shown and described various embodiments of the electrical switch 10 which utilize only one magnet, namely flexible sheet magnet 18. It is to be understood, however, that various alternative embodiments are possible which utilize a second magnet element attracting the flexible sheet magnet to a normal (non-actuated) position. An electrical switch 10 so constructed would still have the many preferred operating characteristics of more preferred embodiments and is within the scope of the present invention.

Thus, it can be seen that there has been shown and described a novel momentary contact magnetic switch. It is to be understood, however, that various changes, modifications and substitutions in the form of the details of the present invention can be made by those skilled in the art without departing from the scope of the invention as defined by the following claims.

What is claimed is:

1. An electrical switch, comprising:

a magnetic cover plate having a plurality of apertures therein;

a flexible sheet magnet positioned in back of said cover plate at least partially covering said plurality of apertures, said flexible sheet magnet being positioned in a normal position magnetically attracted to said cover plate and being in part flexibly movable to an actuated position away from said cover plate at one of said plurality of apertures by manual actuation through said one of said plurality of apertures; and contact means for each plurality of apertures positioned in cooperation with said flexible sheet magnet, said contact means for providing a change in electrical continuity when said flexible sheet magnet is moved between said normal position and said actuated position.

2. An electrical switch as in claim 1 wherein said cover plate comprises:

a housing having a plurality of apertures therein, said housing substantially enclosing the front of said switch; and a magnetic plate having a plurality of apertures therein substantially matching said plurality of apertures in said housing, said magnetic plate being mounted to said housing.

3. An electrical switch as in claim 1 wherein each said contact means comprises a pair of contacts operable when said flexible sheet magnet is flexibly moved between said normal position and said actuated position.

4. An electrical switch as in claim 3 wherein one of said pair of contacts is stationary and the other of said pair of contacts is responsive to movement of said flexible sheet magnet.

5. An electrical switch as in claim 4 wherein said pair of contacts is electrically open when said flexible sheet magnet is in said normal position and wherein said pair of contacts is electrically closed when said flexible sheet magnet is in said actuated position.

6. An electrical switch as in claim 4 wherein said pair of contacts is electrically closed when said flexible sheet magnet is in said normal position and wherein said pair of contacts is electrically open when said flexible sheet magnet is in said actuated position.

7. An electrical switch as in claim 1 wherein each of said contact means comprises a set of stationary contacts and a bridging conductor operable when said flexible sheet magnet is flexibly moved between said normal position and said actuated position.

8. An electrical switch as in claim 1 which further comprises a back plate positioned opposite said cover plate.

9. An electrical switch as in claim 10 which further comprises adhesive means attached to said back plate, said adhesive means for mounting said electrical switch on a flat surface.

10. An electrical switch as in claim 8 wherein said contact means comprises:

a first contact responsive to said flexible sheet magnet; and a second contact at least partially aligned with said first contact.

11. An electrical switch as in claim 10 wherein said contact assembly further comprises an apertured spacer separating said first contact from said second contact when said flexible sheet magnet is in said normal position but allowing electrical coupling between said first contact and said second contact when said flexible sheet magnet is in said actuated position.

12. An electrical switch as in claim 8 wherein said back plate is conductive and wherein said back plate comprises one of a plurality of contacts in said contact means.

13. An electrical switch as in claim 8 wherein said contact means comprises a movable bridging conductor and a stationary set of contacts capable of being electrically connected by said bridging conductor, said set of contacts operable when said flexible sheet magnet is flexibly moved between said normal position and said actuated position.

14. An electrical switch as in claim 13 wherein said back plate contains said set of contacts.

15. An electrical switch as in claim 1 wherein flexible sheet magnet is comprised of ferrite particles dispersed in a nonmagnetic binder.

16. An electrical switch as in claim 15 wherein said flexible sheet magnet is of the type having alternating poles.

17. An electrical switch as in claim 16 which further comprises a flux return plate positioned opposite said flexible sheet magnet from said cover plate.

18. An electrical switch as in claim 15 wherein said flexible sheet magnet is in contact with said cover plate when in said normal position.

19. An electrical switch as in claim 18 wherein said flexible sheet magnet is substantially coextensive with said cover plate.

20. A bidirectional electrical switch, comprising:

a back plate;

a magnetic cover plate having a plurality of apertures therein, said cover plate being positioned over said back plate;

a flexible sheet magnet mounted between said back plate and said cover plate in a normal position magnetically attracted to said cover plate and being in part flexibly movable to an actuated position away from said cover plate by manual actuation through one of said plurality of apertures;

contact means positioned in cooperation with said flexible sheet magnet, said contact means having a pair of contacts for each of said plurality of apertures individually operable when said flexible sheet magnet is moved between said normal position and said actuated position;

a first wire coupled to a first of said pair of contacts for each of said plurality of apertures;

first and second diodes individually coupled to a second of said pair of contacts for each of said plurality apertures and coupled together at a juncture, said first and second diodes being oppositely oriented; and a second wire coupled to said juncture.

21. An electrical switch, comprising;

a magnetic cover plate having an aperture therein;

a flexible sheet magnet positioned in back of said cover plate in a normal position magnetically attracted to said cover plate and movable to an actuated position away from said cover plate by manual actuation through said aperture; and a pair of contacts operable when said flexible sheet magnet is moved between said normal position and said actuated position;

one of said pair of contacts being stationary and the other of said pair of contacts being responsive to the movement of said flexible sheet magnet;

said pair of contacts being electrically closed when said flexible sheet magnet is in said normal position and said pair of contacts being electrically opened when said flexible sheet magnet is in said actuated position;

wherein said cover plate is electrically conductive and wherein said cover plate is one of said pair of contacts which is stationary.

* * * * *